United States Patent [19]

Hoshino et al.

[11] Patent Number: 4,674,814

[45] Date of Patent: Jun. 23, 1987

[54] CONNECTOR ASSEMBLY

[75] Inventors: Teruaki Hoshino, Higashiyamato; Koichi Kamiji, Utsunomiya, both of Japan

[73] Assignees: Japan Aviation Electronics Industry Limited; Honda Giken Kogyo Kabushiki Kaisha, both of Tokyo, Japan

[21] Appl. No.: 880,629

[22] Filed: Jul. 1, 1986

[30] Foreign Application Priority Data

Jul. 8, 1985 [JP] Japan ..... 60-149497

[51] Int. Cl.[4] ..... H01R 13/639

[52] U.S. Cl. ..... 439/586; 439/372; 439/701; 439/489

[58] Field of Search ..... 339/75 R, 75 M, 91 R, 339/61 R, 61 M, 59 R, 59 M, 63 R, 63 M

[56] References Cited

U.S. PATENT DOCUMENTS

| | | | |
|---|---|---|---|
| 3,178,674 | 4/1965 | Scheller | 339/91 R |
| 3,239,791 | 3/1966 | Fyrk | 339/63 R |
| 3,250,551 | 5/1966 | Draudt | 339/91 R |
| 4,253,718 | 3/1981 | Bungo | 339/59 R |
| 4,607,903 | 8/1986 | Hoshino et al. | 339/63 R |

FOREIGN PATENT DOCUMENTS

| | | | |
|---|---|---|---|
| 3415640 | 10/1984 | Fed. Rep. of Germany | 339/91 R |
| 2018048 | 10/1979 | United Kingdom | 339/91 R |

*Primary Examiner*—John McQuade

*Attorney, Agent, or Firm*—Pollock, Vande Sande and Priddy

[57] ABSTRACT

A connector assembly is disclosed, in which elastic contact and electric connection between first contacts supported in a first contact body and second contacts supported in a second connector body is obtained when the second connector body is inserted into the first connector body through an opening. Automatic lock means is provided which automatically locks the second connector body to the first connector body when the former is correctly inserted into the latter. The first connector body has one surface formed with a complementary recess and an aperture extending from the bottom of the recess to reach the opening. A lock piece integral with the first connector body can be turned to be received in the complementary recess. The lock piece has an integral engagement ridge. When the lock piece is received in the complementary recess in a state where the second connector body is correctly inserted in the first connector body, the engagement recess passes through the aperture to be engaged with an engagement recess formed in the second connector body, whereby the first and second connector bodies are locked in a correctly coupled state.

8 Claims, 7 Drawing Figures

CONNECTOR ASSEMBLY

BACKGROUND OF THE INVENTION

This invention relates to a connector assembly in which electric connection between first contacts supported in a first connector body and second contacts supported in a second connector body is obtained when the second connector body is inserted into the first connector body, and more particularly relates to a structure for maintaining the first and second contacts in contact with each other.

In the prior art connector assembly of this type, pin contacts extend from the inner surface of a pin connector body facing a front opening thereof. When a socket connector body is inserted into a pin connector body through the front opening thereof, the pin contacts are fitted into socket contacts supported in the socket connector body, so that elastic contact and electric connection between the pin contacts and socket contacts are obtained.

However, when the socket connector body is inserted into the pin connector body insufficiently, good electric connection between the pin contacts and socket contacts can not be obtained. In addition, pin contacts and socket contacts which have been brought into contact, are liable to get out of contact with one another due to vibrations or other causes. Accordingly, an arrangement has been suggested heretofore wherein, when the socket connector body is sufficiently inserted into the pin connector body, a pawl provided on the outer surface of the leading end of the socket connector body is brought into engagement with a pawl provided on the bottom inner surface of the pin connector body, whereby both the bodies are locked to each other. The pin connector body is provided with an outer lever capable of elastic deformation, while the socket connector is provided with a rockable see-saw lever facing the pin connector body lever. By turning the see-saw lever from the outside, the pin connector body lever is displaced to release the engagement between the pawls, thus releasing the lock. This lock is called a see-saw lock or a cantilever lock. In this arrangement, the pin connector body has a pawl projecting from the inner surface near the front opening. When the socket connector body is sufficiently inserted into the pin connector body, a pawl provided on a cantilever integral with the outer surface of the socket connector body is brought into engagement with the pin connector body pawl, so that the two bodies are locked to each other. By causing a displacement of the cantilever, the two pawls are disengaged to release the lock.

With reduction of the connector size, however, it has become difficult with the prior art lock systems to confirm from a click touch or a mounting sound that a lock of the two bodies is obtained. Further, when a small size connector assembly is used for electric connection in a vehicle, for instance, disconnection of the contacts is liable to result due to vibrations.

Further, the socket contacts have to be held at predetermined positions (regular positions) in the socket connector body. Otherwise, the pin contacts and socket contacts are liable to be brought into unsatisfactory contact or not brought into contact at all when the socket connector body is inserted into the pin connector body.

Accordingly, there has been proposed a twofold lock structure as disclosed in, for instance, U.S. Pat. No. 3,239,791 (issued on Mar. 8, 1966). In this case, each of the first and second connector bodies has an integral cover member provided on one surface and capable of being turned. After the first and second connector bodies are coupled together, each cover member is turned to be fitted and engaged with a receiving member provided on the opposite connector body, whereby the two connector bodies are locked together in a coupled state. In this twofold lock structure, the two locks are alike, and each cover member is turned to effect a lock. Therefore, the locking operation is rather cumbersome, and the twofold lock can not be obtained if the operation of turning either one of the cover members is neglected. Further, it is difficult to adopt this twofold lock structure where one of the connector bodies is secured to a substrate and the connector bodies are comparatively small in size. Further, the cover members project outwardly. Therefore, the lock is readily released when an object strikes a cover member. Still further, the cover member also serves as a lid to close the opening of the connector body. Therefore, the size of the cover member is increased with increase of the number of contacts.

The present inventors have proposed a different twofold lock structure for a connector assembly, as disclosed in FIGS. 1 to 4 and the related description of U.S. Pat. No. 4,607,903 issued Aug. 26, 1986, "Connector Assembly". In this case, the two locks are of different types, and one of them is an automatic lock, and only a single manual locking operation is necessary. However, a lock piece projects outwardly, so that a lock is liable to be released by an external force that is applied when an object strikes the lock piece.

SUMMARY OF THE INVENTION

An object of the invention is to provide a connector assembly in which a lock cannot be accidentally released when an object strikes a lock piece.

Another object of the invention is to provide a connector assembly which has two lock means, one of these lock means being automatic lock means, the automatic lock being capable of being confirmed by the lock of the other lock means, the lock of the other lock means being incapable of accidental release when an object strikes the lock means.

According to the invention, the first connector body is a synthetic resin molding and has an opening, through which the second connector body is inserted into the first connector body. The first connector body has a complementary recess formed on one side and an aperture extending from the bottom of the recess and communicating with the opening. First contacts are supported in the first connector body. They extend from the inner surface of the first connector body facing the opening thereof forwardly in the direction of insertion and removal of the second connector body. The first connector body has an integral lock piece which can be turned to be received in the complementary recess noted above. The lock piece has an integral engagement ridge. When the lock piece is received in the recess, the engagement ridge penetrates the aperture toward the opening. When the second connector body is inserted into the first connector body through the opening so that second contacts supported in the second connector body are brought into correct contact with the first contacts, the engagement ridge is engaged in an engagement recess formed on the outer periphery of the second connector body to restrict the relative movement thereof in the direction of inserting and removing connector. Thus, it can be confirmed that the first and second contacts are in correct contact with one another. Also, the first and second connector bodies are locked in a coupled state.

The first and second connector bodies are also provided with second lock means for automatically locking the first and second connector bodies to each other when they are correctly coupled together. This second lock means may consist of a cantilever provided on either the first or second connector body. When the first and second connector bodies are coupled together, an end of the cantilever is slightly displaced, and then the cantilever restores to its initial state to engage with the other connector body in the direction of inserting and removing the socket connector. In consequence, the two connector bodies are automatically locked to each other.

DESCRIPTION OF THE PREFERRED EMBODIMENTS

Figure 1:
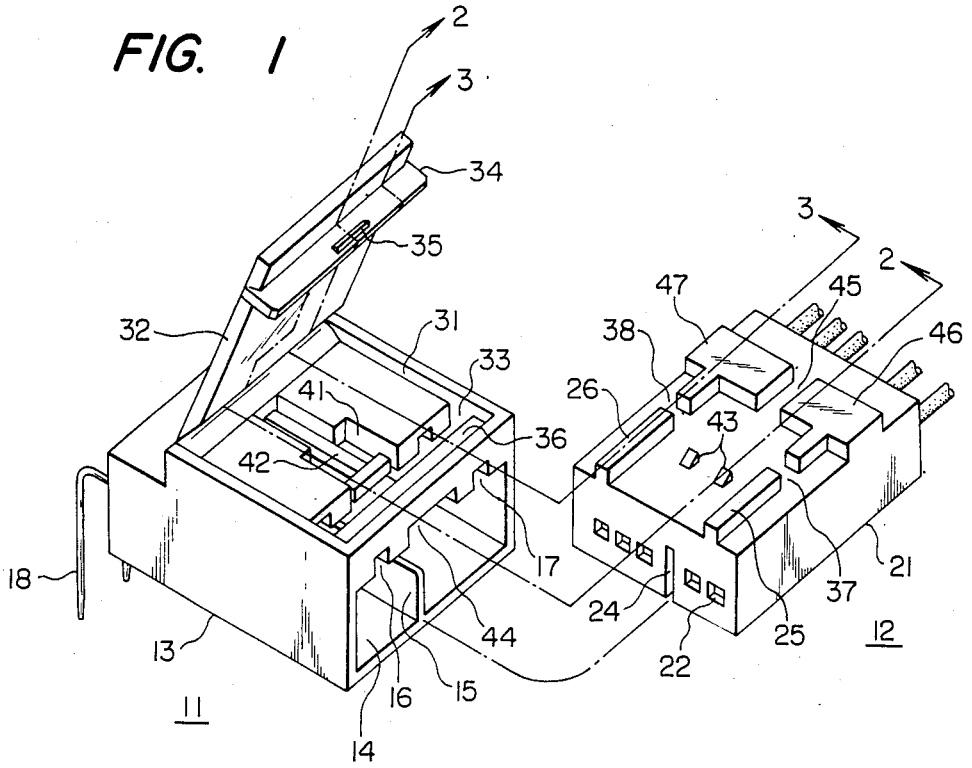
FIG. 1 is a perspective view showing an embodiment of the connector assembly according to the invention with a pin connector 11 and a socket connector 12 shown separated from each other.
Figure 2:
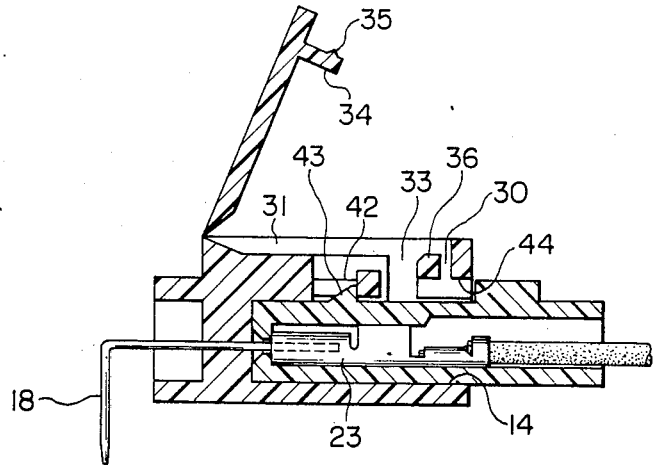
FIG. 2 is a sectional view corresponding to a section taken along line 2—2 in FIG. 1.

FIG. 1 shows an embodiment of the connector assembly according to the invention. The connector assembly comprises a first connector and a second connector. In this embodiment, the first and second connectors are a pin connector 11 and a socket connector 12, respectively. The pin connector 11 consists of a substantially rectangular connector body 13 and a rectangular lid-like lock piece 32, which are formed by a synthetic resin molding, the connector body 13 having a front opening 14. The socket connector 12 can be inserted into and removed from the pin connector 11 through the front opening 14. The inner wall surface of the connector body 13 adjacent to the front opening 14 is provided with a guide ridge 15 extending in the longitudinal direction, i.e., in the direction of insertion and removal of the socket connector. The connector body inner surface facing the guide ridge 15 is formed with two guide grooves 16 and 17 extending in the longitudinal direction. As shown in FIGS. 1 and 2, a plurality of pin contacts 18 are held as first contacts in the connector body 13. The pin contacts 18 extend in the longitudinal direction along the connector body inner surfaces adjacent to the front opening.

The socket connector 12 also consists of a substantially rectangular connector body 21 which is a synthetic resin molding. The connector body 21 has a plurality of contact reception bores 22 extending in the longitudinal direction. A socket contact 23 is received and held as a second contact in each of the contact reception bores 22, as shown in FIG. 2. The bottom of the connector body 21 is formed with a guide groove 24 extending in the longitudinal direction. The top of the connector body 21 is provided with two guide ridges 25 and 26 extending in the longitudinal direction. The connector body 21 can be substantially snugly fitted into the connector body 13 through the front opening 14. At this time, the guide ridge 15 and guide grooves 16 and 17 of the connector body 13 and the guide groove 24 and guide ridges 25 and 26 of the connector body 21 engage and guide one another. Each pin contact 18 is inserted into a corresponding socket contact 23 and electrically connected to the socket contact 23 in elastic contact therewith.

Further, this embodiment is provided with lock means, which ensures a correct contact between pin contacts 18 and socket contacts 23 and locks the pin connector 11 and socket connector 12 in a mutually coupled state. More specifically, the connector body 13 has a shallow recess 31 formed in the top surface thereof. In FIG. 1, the recess 31 is formed as a rectangular recess substantially over the entire top surface of the connector body 13 in complementary shape to the lock piece 32. The lock piece 32 can be turned i.e., pivoted about a hinge at its rear end, so as to be received in the complementary recess 31. An aperture 33 is formed in the bottom of the recess 31 to reach the front opening 14. In this embodiment, the aperture 33 is an elongate slot extending substantially at right angles to the direction of insertion and removal of the socket connector 12. In the bottom of the recess 31 is also formed a slot 30 immediately behind the front wall of the connector body 13, thereby defining a bridge 36 extending between opposite side walls of the connector body 13.

Figure 3:
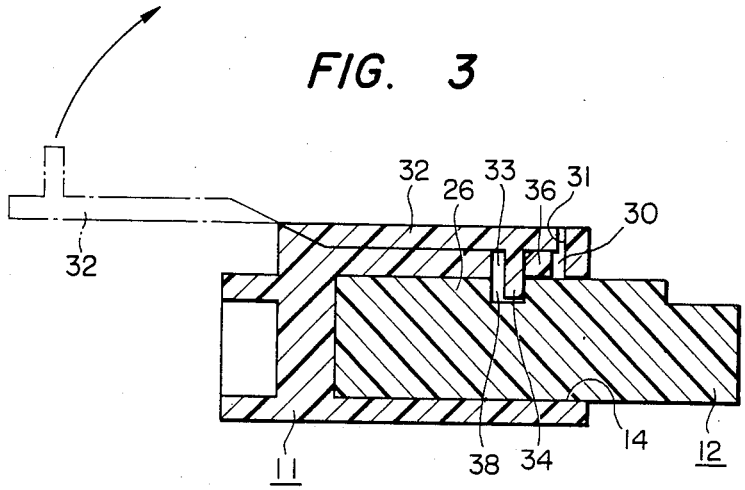
FIG. 3 is a sectional view corresponding to a section taken along line 3—3 in FIG. 1 with the pin connector 11 and socket connector 12 of FIG. 1 shown coupled together.

The lock piece 32 has an integral ridge 34. When the lock piece 32 is turned and received in the complementary recess 31, the ridge 34 extends into and substantially fills the aperture 33. In the aperture 33, the ridge 34 extend into and across both of the guide grooves 16 and 17 above the front opening 14. As shown in FIG. 3, the outer surface of the lock piece 32, when the lock piece is properly received in the recess 31, is substantially flush with the top of the connector body 13. To retain the lock piece 32 in this position, the ridge 34 is provided with a triangular protuberance 35 formed on a central portion of the front surface thereof for engagement with the bridge 36.

The connector body 21 of the socket connector 12, on the other hand, has an engagement space, in which the ridge 34 is received. In this embodiment, the engagement space is constituted by recesses 37 and 38 formed in the guide ridges 25 and 26. When the connector body 21 inserted into the connector body 13 through the front opening 14 up to a regular position so that the pin contacts 18 are correctly inserted into and connected to the socket contacts 23, the ridge 34 is received in the recesses 37 and 38, thereby locking a correct coupling state between the pin contacts 18 and the socket contacts 23.

Figure 4:
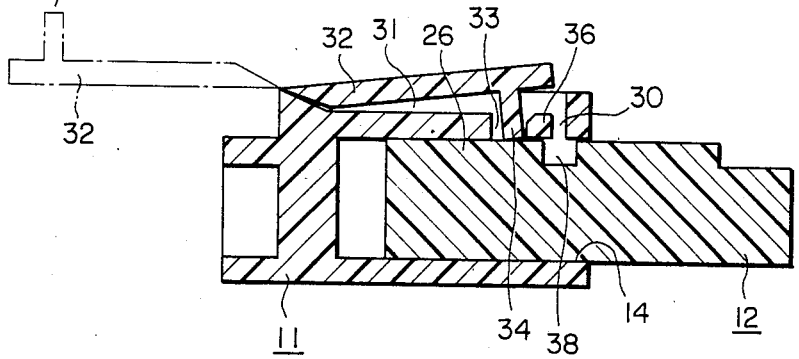
FIG. 4 is a sectional view corresponding to FIG. 3 showing the pin connector 11 and socket connector 12 in a defectively coupled state.

Thus, if the lock piece 32 can be correctly received in the complementary recess 31, i.e., if the triangular protuberance 35 of the lock piece 32 can be engaged with the bridge 36, after the insertion of the socket connector 12 into the pin connector 11, the connection between the pin contacts 18 and socket contacts 23 can be confirmed, and also the socket connector 12 is locked in the pin connector 11. This connection state can be maintained without possibility of detachment of the connectors due to externally applied vibrations. On the other hand, if the pin contacts 18 are not correctly connected to the socket contacts 23 when the socket connector 11 is inserted into the pin connector 11, the ridge 34 strikes the guide ridges 25 and 26, i.e., the lock piece 32 fails to be received in the recess 31 and also the triangular protuberance 35 fails to be engaged with the bridge 36, as shown in FIG. 4, when an attempt is made to pivot the lock piece 32 into the recess 31. In this case, it is immediately apparent that the pin contacts 18 and socket contacts 23 are not correctly connected to one another, and the socket connector 12 may be inserted afresh to obtain correct connection of the pin contacts 18 and socket contacts 23 for use.

When the pin contacts 18 and socket contacts 23 are correctly connected, the lock piece 32 is correctly received in the complementary recess 31, with its outer surface substantially flush with the top of the connector body 13, i.e., the top of the recess 31. Thus, no external force tending to pull the lock piece 32 out of the recess 31 can be applied to the lock piece 32. Therefore, the lock is never released accidentally. The lock piece 32 thus can be reliably held in the recess 31 by the engagement of the triangular protuberance 35 with the bridge 36.

Further, this embodiment is provided with second lock means which automatically locks the socket connector 12 to the pin connector 11 when the former is inserted into the latter. More specifically, as shown in FIG. 1, in the complementary recess 31 of the connector body 13 a cutout space 41 is formed in the bottom of the recess 31. The cutout space 41 extends from a central portion of the aperture 33 to the other end of the recess 31 in the neighborhood of the hinge portion of the lock piece 32. A T-shaped cantilever 42 is disposed in the space 41. A longitudinal portion of the T-shaped cantilever 42 is integral with the connector body 13 in the neighborhood of the hinge portion of the lock piece 32. A transversal portion of the T-shaped cantilever, which is a free end, extends in the neighborhood of and parallel to the aperture 33. The longitudinal portion of the T-shaped cantilever 42 has a reduced thickness to facilitate elastic displacement.

On the other hand, a pair of wedges 43 are provided side by side between the guide ridges 25 and 26 of the connector body 21 of the socket connector 12. When the socket connector 12 is inserted into the pin connector 11, the transversal portion of the T-shaped cantilever 42 is raised and elastically displaced by the wedges 43. When the transversal portion clears the wedges 43, it is restored, whereby the T-shaped cantilever 42 is engaged with the wedges 43, as shown in FIG. 2. In this way, the socket connector 12 and pin connector 11 are automatically locked in the coupled state. In this state, the pin contacts 18 and socket contacts 23 are correctly connected. This lock by the second lock means is guaranteed by the lock of the lock piece 32. The pin connector 11 has a release recess 44, which is open at the front adjacent to the front opening 14 between the guide grooves 16 and 17. The socket connector 12 has a channel 45 formed between raised lands 46 and 47 at the rear ends of the guide ridges 25 and 26. The engagements between the triangular protuberance 35 and the bridge 36 and between the T-shaped cantilever 42 and wedges 43 can be simultaneously released by inserting an acute wedge bar (not shown) through the channel 45 and the release recess 44 into small gaps between the top surface of the connector body 21 and the respective ridge 34 and cantilever 42.

Figure 5:
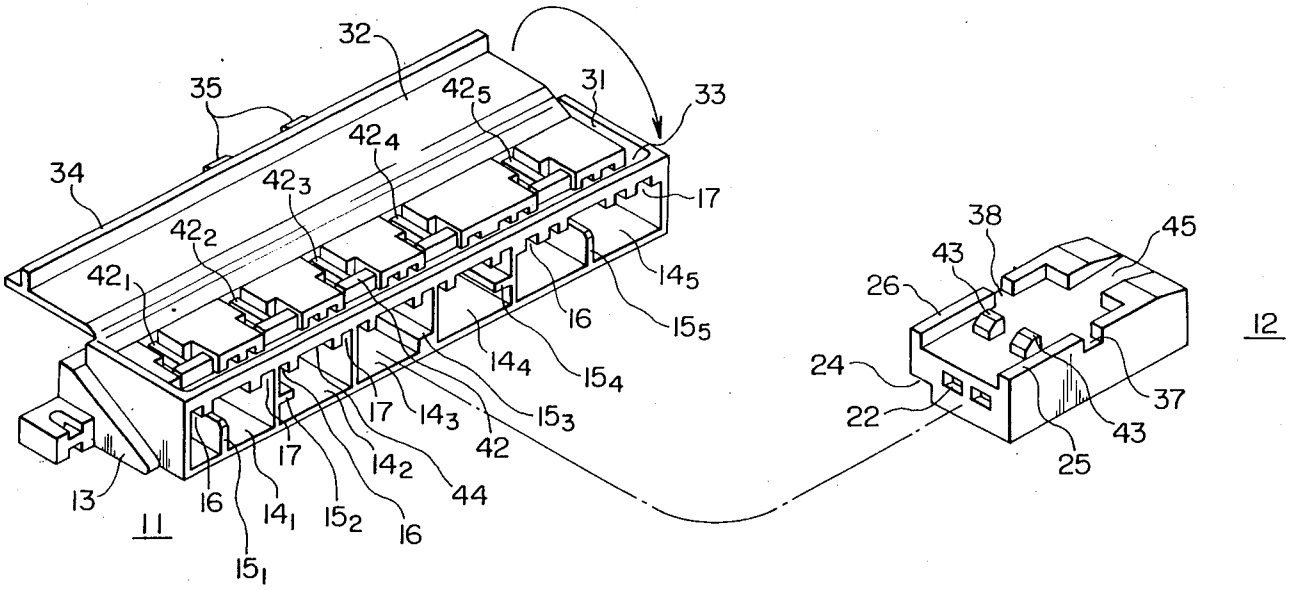
FIG. 5 shows a different embodiment of the invention, with a pin connector 11 having a plurality of front openings $14_1$–$14_5$ and one socket connector 12 to be inserted through one of the front openings being shown in a perspective view.

FIG. 5 shows a different embodiment of the invention. In this embodiment, a pin connector 11 has a plurality of front openings $14_1$ to $14_5$, and separate socket connectors are inserted into the pin connector 11 through the respective front openings 14. In FIG. 5, only a single socket connector 12 is shown. The pin connector 11 has a shallow complementary recess 31 formed substantially over the entire top of connector body 13. An aperture 33 is formed in the bottom of the recess 31 to extend across the respective openings $14_1$–$14_5$ and communicates therewith. Plural cutout spaces $41_1$–$41_5$ are also formed in the bottom of the recess 31, in which are provided with T-shaped cantilevers $42_1$–$42_5$ of the same shape as the T-shaped cantilever 42 shown in FIG. 1 and each of which corresponds to each of the front openings $14_1$–$14_5$. The pin connector 11 also has a lock piece 32 integral with the connector body 13 and adapted to be received in the recess 31. The lock piece 32 has an integral ridge 34 which is received in the aperture 33. Further, guide grooves 16 and 17 are provided for each of the front openings $14_1$–$14_5$.

Each socket connector 12 has a construction substantially similar to the one shown in FIG. 1, so its parts like those in FIG. 1 are designated by like reference numerals and are not described in detail. In this embodiment, a plurality of socket connectors 12 can be locked by the common lock piece 32. The socket connectors 12 that are to be inserted into the openings $14_1$–$14_5$ are respectively identified by the different positions of their respective guide grooves 24 corresponding to the various different positioned mating guide ridges $15_1$–$15_5$ in the openings $14_1$–$14_5$ of the pin connector 11.

Figure 6:
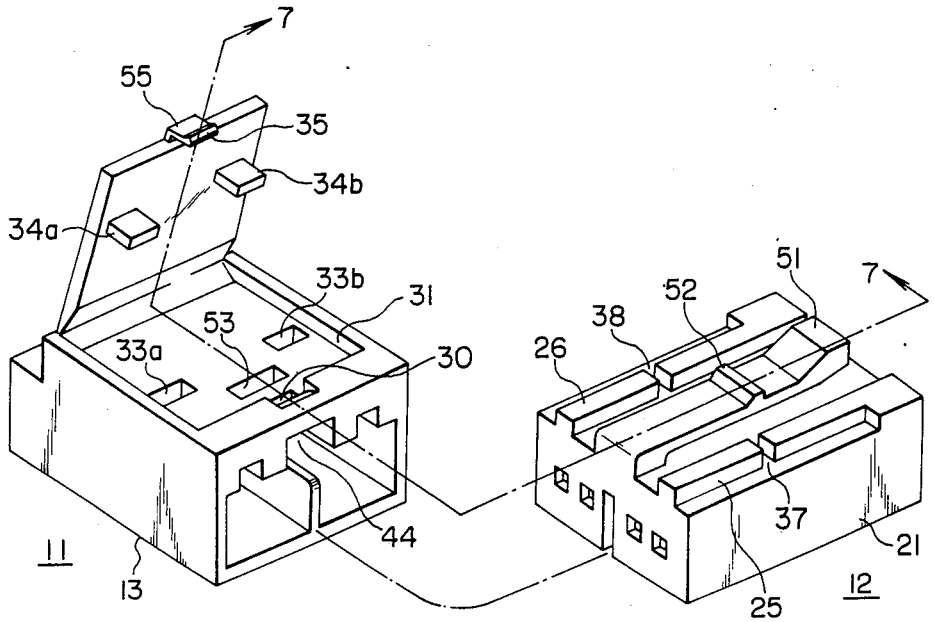
FIG. 6 is a perspective view showing a further embodiment of the invention, in which an automatic lock cantilever is provided on a socket connector 12.
Figure 7:
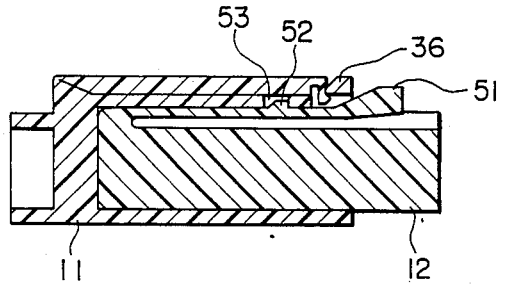
FIG. 7 is a sectional view corresponding to a section taken along line 7—7 in FIG. 6 with the pin connector and socket connector of FIG. 6 shown in a coupled state.

The cantilever of the second lock means may be provided on the socket connector 12 instead of on the pin connector 11. FIG. 6 shows one such example. In the Figure, parts like those shown in FIG. 1 are designated by like reference numerals. More specifically, a socket connector 12 has a longitudinally extending cantilever 51 provided on connector body 21 between guide ridges 25 and 26. The cantilever 51 is integral at the front end with the connector body 21. It has a pawl 52 formed on the outer surface of its intermediate portion. The pin connector 11 has a cantilever guide recess 44 in the inner wall of the front opening 14. The cantilever 51 is guided through the recess 44. The pin connector 11 further has an engagement hole 53 formed in a front central portion of the bottom of the recess 31. When the socket connector 12 is inserted into the pin connector 11, the pawl 52 is brought into contact with the lower edge of the slot 30. After displacement of the cantilever 51, the cantilever 51 is restored when the pawl 52 is received in the engagement hole 53 as shown in FIG. 7. When the pawl 52 is received in the hole 53, the socket connector 12 is automatically locked in the pin connector 11.

In this embodiment, the bottom of the recess 31 is provided with apertures 33*a* and 33*b* in correspondence to the recesses 37 and 38 of the socket connector 12, and the lock piece 32 is provided with engagement protuberances 34*a* and 34*b*. Further, the lock piece 32 has a hook-like portion 55 formed on a central portion of the front end thereof. The hook-like portion 55 has a triangular protuberance 35.

In the above description, the two protuberances 34*a* and 34*b* are provided for engagements at two points, i.e., recesses 37 and 38. However, the same effect may be obtained by providing a single engagement point for the ridge. Further, it is possible to form a recess or two in the bottom surface of the recess 31 instead of forming recesses 37 and 38 in the guide ridges 25 and 26 or like ridges. Further, the lock piece 32 may be integrally provided on the connector body 13 such that it can be turned about an axis parallel to the direction of insertion and removal of the connector. Further, the invention is applicable where a pin connector accommodating pin contacts is inserted into a socket connector accommodating socket contacts.

As has been described in the foregoing, according to the invention it is possible to confirm correct contact between the first and second contacts of the first and second connectors and lock the two connectors in a coupled state simply by turning the lock piece 32 according to the invention. This operation consists of a single operation. Further, since the lock piece 32 is received in the complementary recess 31, it will not be released easily from the lock by an external accidental force applied to the coupled connectors. Further, where automatic lock means is incorporated, the locked state by the automatic lock means can be confirmed by the operation of turning the lock piece 32.

We claim:

1. A connector assembly in which electric connection between first contacts supported in a first connector body and second contacts supported in a second connector body is obtained when said second connector body is inserted into said first connector body, said first connector body consisting of a substantially rectangular synthetic resin molding having an opening in a front side thereof through which opening said second connector body is inserted, a complementary recess formed in a top side of said first connector body, and an aperture in said first connector body extending from the bottom of said complementary recess and communicating with said opening;

said first contacts being supported in said first connector body such that they extend from a surface thereof facing said opening substantially at right angles to said surface toward said opening; and a lock piece having a shape which is substantially complementary to the shape of said complementary recess, said lock piece being hingedly connected to said first connector body such that said lock piece can be turned to be received in said complementary recess, said lock piece having an integral engagement ridge, said engagement ridge occupying said aperture and extending toward said opening when said lock piece is received in said complementary recess, and engaging, in this state in the direction of insertion and removal of said second connector body, with said second connector body correctly inserted in said first connector body through said opening, thus locking said second connector body to said first connector body.

2. The connector assembly according to claim 1 wherein said second connector body has an engagement recess formed in one side face thereof, said engagement recess being so positioned that, when said lock piece is received in said complementary recess and said first and second contacts are correctly connected after the insertion of said second connector body into said first connector body, said engagement ridge is received in said engagement recess with the back surface of said engagement ridge facing the front surface of said engagement recess.

3. The connector assembly according to claim 2, which further comprises locking means provided on said lock piece and in said complementary recess for locking said lock piece when said lock piece is correctly received in said complementary recess.

4. The connector assembly according to claim 3, which further comprises automatic locking means provided on said first and second connector bodies for automatically locking said second connector body to said first connector body when said second connector body is correctly inserted into said first connector body through said opening.

5. The connector assembly according to claim 2, wherein said first connector body has a longitudinally extending guide groove formed in an inner surface of said opening, and said second connector body has an integral guide ridge formed on said one side face to extend in the longitudinal direction, said guide ridge being received in said guide groove, said engagement recess being formed in said guide ridge.

6. The connector assembly according to claim 4 wherein said automatic lock means includes a cantilever formed integrally with said first connector body to extend forwardly in the longitudinal direction in a cutout space formed in the bottom of said complementary recess, and a wedge formed on said one side face of said second connector body, said cantilever being displaced by said wedge and then click engaged with said wedge in the longitudinal direction when said second connector body is correctly inserted in said first connector body through said opening.

7. The connector assembly according to claim 4, wherein said automatic lock means includes an engagement hole formed in an inner surface of said opening of said first connector body and a cantilever formed integrally on said one side face of said second connector body to extend rearwardly in the longitudinal direction, said cantilever having a pawl provided on an intermediate portion for engaging with said engagement hole when said second connector body is correctly inserted into said first connector body through said opening.

8. The connector assembly according to claim 4 wherein said first connector body has a plurality of said openings arranged side by side in a row for receiving thereinto a plurality of said second connector bodies, said complementary recess being formed in a surface of said first connector body that is parallel to the direction of arrangement of said openings and covering the entire row of said openings, said lock piece extending along said row of openings to be received in said complementary recess, said lock piece having at least one integral engagement ridge capable of being received in the engagement recesses of each of said second connector bodies that are inserted into said first connector body through each said opening, said automatic lock means being provided on said second connector bodies and corresponding portions of said first connector body.

* * * * *